US010975561B2

(12) United States Patent
Kwon et al.

(10) Patent No.: US 10,975,561 B2
(45) Date of Patent: Apr. 13, 2021

(54) METHOD AND DEVICE FOR CONTROLLING VENTILATION AMOUNT WITH RESPECT TO SEALED PIPE

(71) Applicant: SCENTEC INC., Ansan-si (KR)

(72) Inventors: Yong Sog Kwon, Gwacheon-si (KR); Shi Cheal Shin, Gunpo-si (KR); Kyu Chui Jung, Suwon-si (KR); Jae Wang Chung, Suwon-si (KR)

(73) Assignee: SCENTEC INC., Ansan-si (KR)

( * ) Notice: Subject to any disclaimer, the term of this patent is extended or adjusted under 35 U.S.C. 154(b) by 138 days.

(21) Appl. No.: 16/472,288

(22) PCT Filed: Nov. 21, 2017

(86) PCT No.: PCT/KR2017/013235
§ 371 (c)(1),
(2) Date: Jun. 21, 2019

(87) PCT Pub. No.: WO2018/124477
PCT Pub. Date: Jul. 5, 2018

(65) Prior Publication Data

US 2020/0332510 A1 Oct. 22, 2020

(30) Foreign Application Priority Data

Dec. 27, 2016 (KR) ..... 10-2016-0180101

(51) Int. Cl.
*E03F 5/08* (2006.01)
*F24F 11/63* (2018.01)
(Continued)

(52) U.S. Cl.
CPC ..... *E03F 5/08* (2013.01); *F24F 7/007* (2013.01); *F24F 11/30* (2018.01); *F24F 11/63* (2018.01); *F24F 11/72* (2018.01); *F24F 2110/10* (2018.01)

(58) Field of Classification Search
CPC .... E03F 5/08; F24F 11/63; F24F 11/72; F24F 11/30; F24F 7/007
See application file for complete search history.

(56) References Cited

U.S. PATENT DOCUMENTS 8,834,613 B2 9/2014 Kwon et al.

FOREIGN PATENT DOCUMENTS

JP H07-158134 A 6/1995
JP H10-195947 A 7/1998
(Continued)

*Primary Examiner* — Christine J Skubinna
(74) *Attorney, Agent, or Firm* — Rabin & Berdo, P.C.

(57) ABSTRACT

The present disclosure relates to a method of controlling a ventilatory volume for inhibiting a release of a harmful gas such as an offensive odor or a toxic substance from a closed-type duct. The method of controlling a ventilatory volume is characterized in that (i) the closed-type duct is divided into a single main duct and multiple branch ducts in a planned area and depends on a harmful gas prevention closed-type duct model in which a negative pressure may be formed by a separately provided means for forcedly discharging gas, (ii) in a state in which no forced gas discharge from the closed-type duct is made, the harmful gas is determined as a standard flow velocity by comparing inverse velocity values of natural positive-pressure flow velocities according to a difference in temperature, a difference in concentration, a difference in elevation of the duct, a stack effect, and the like, (iii) the standard flow velocity is assigned in a lump to flow velocities in the single main duct and the multiple branch ducts provided in the closed-type duct, a sum of the flow rate in the main duct and the flow rate in the multiple branch ducts is basically determined as a ventilatory volume by the means for forcedly discharging gas, and particularly, only the flow rates in the branch duct at the junction points are corrected and determined in a lump based on a ratio of a pressure loss in the main duct to a (Continued)

pressure loss in the branch duct. The method of controlling a ventilatory volume may be applied to the closed-type duct having various usages and shapes and may provide a quantitative criterion related to a minimum ventilatory volume required to inhibit a release of a harmful gas, thereby reducing costs, maximizing operational efficiency, and an operational criterion practical to various types of ventilation devices.

20 Claims, 6 Drawing Sheets

(51) Int. Cl.

| | |
|---|---|
| ***F24F 11/72*** | (2018.01) |
| ***F24F 11/30*** | (2018.01) |
| ***F24F 7/007*** | (2006.01) |
| ***F24F 110/10*** | (2018.01) |

(56) References Cited

FOREIGN PATENT DOCUMENTS

| | | | |
|---|---|---|---|
| JP | 3680030 | B2 | 8/2005 |
| JP | 2007-332634 | A | 12/2007 |
| KR | 10-1152571 | B1 | 6/2012 |

Figure 1

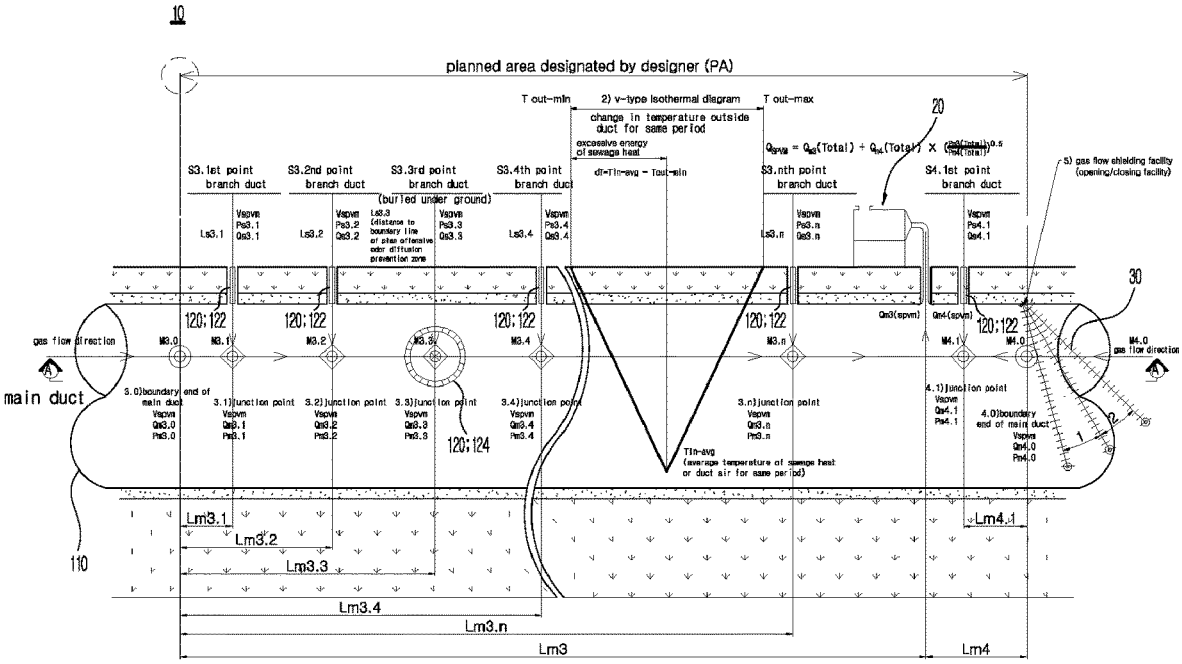

| <symbol index table> | |
|---|---|
| ◎ | indication of non-junction point (indication of single main duct) |
| ◇ | indication of main/branch duct junction point (longitudinal junction) |
| ⊗ | indication of main/branch duct junction point (transverse junction) |
| $Q_{spvm}$ | ventilatory volume through duct ventilation model (spvm) |
| Qm 3.0~3.n | ventilatory volume of offensive odor diffusion prevention closed-type duct main duct ~ point ventilatory volume |
| Qs 3.1~3.n | branch duct ~ point ventilatory volume |
| Pm 3.0~3.n | main duct ~ point pressure loss |
| Ps 3.1~3.n | branch duct ~ point pressure loss |
| $V_{spvm}$ | value of linear velocity of calculation theory of spvm ventilatory volume |
| Ls 3.1~3.n | indication of ~ point branch duct length which is variable for calculating spvm duct pressure loss |
| Lm 3.1~3.n | indication of ~ point main duct length which is variable for calculating spvm duct pressure loss |
| gas flow shielding facility | spvm, offensive odor diffusion prevention ventilatory volume, duct shield ratio for ensuring economic feasibility |

| <duct index table> | |
|---|---|
| | indication of introduction duct |
| | indication of deodorization device embedded with fan |
| | indication of buried closed-type duct (cover thickness) |
| | indication of closed-type duct |
| | indication of gas flow shielding device for closed-type duct |
| | indication of merging duct buried under ground |
| | (rainwater collector) branch duct |

Figure 4

| daily difference in temperature between inside and outside (℃/day) | difference in pressure (mmAq) | positive-pressure flow velocity according to difference in temperature (m/s) |
|---|---|---|
| 1 | $4.3\times10^{-4}$ | 0.081 |
| 2 | $8.7\times10^{-4}$ | 0.115 |
| 3 | $1.3\times10^{-3}$ | 0.141 |
| 4 | $1.7\times10^{-3}$ | 0.163 |
| 5 | $2.1\times10^{-3}$ | 0.182 |
| 6 | $2.6\times10^{-3}$ | 0.199 |
| 7 | $3.0\times10^{-3}$ | 0.215 |
| 8 | $3.5\times10^{-3}$ | 0.230 |
| 9 | $3.9\times10^{-3}$ | 0.244 |
| 10 | $4.3\times10^{-3}$ | 0.257 |
| ⋮ | ⋮ | ⋮ |

Figure 5

| name of harmful gas in fluid | measurement distance (m) | traveling time (s) | positive-pressure flow velocity according to difference in concentration (m/s) |
|---|---|---|---|
| ammonia | 0.5 | 20 | 0.0250 |
| hydrogen sulfide | 0.5 | 18 | 0.0278 |
| methyl mercaptan | 0.5 | 17 | 0.0294 |

Figure 6

| fluid flow velocity (m/s) | ventilation force according to difference in elevation (mmAq) | positive-pressure flow velocity according to difference in elevation (m/s) |
|---|---|---|
| 0.5 | 0.00153 | 0.15811 |
| 1 | 0.00611 | 0.31623 |
| 1.8 | 0.01980 | 0.56921 |
| 2 | 0.02444 | 0.63246 |
| 2.5 | 0.03819 | 0.79057 |
| 3 | 0.05500 | 0.94868 |

Figure 7

| difference in height h,($h-h_{rpl}$) (m) | vertical difference in pressure (mmAq) | positive-pressure flow velocity according to stack effect (m/s) |
|---|---|---|
| 10 | 0.118627983 | 1.39486 |
| 100 | 1.186279834 | 4.41095 |
| 200 | 2.372559668 | 6.23802 |

Figure 8

| condition | | | determination of standard flow velocity |
|---|---|---|---|
| positive-pressure flow velocity according to difference in temperature | < | positive-pressure flow velocity according to difference in concentration<br>positive-pressure flow velocity according to difference in elevation<br>positive-pressure flow velocity according to stack effect | positive-pressure flow velocity according to difference in concentration<br>positive-pressure flow velocity according to difference in elevation<br>positive-pressure flow velocity according to stack effect |
| positive-pressure flow velocity according to difference in temperature | > | positive-pressure flow velocity according to difference in concentration<br>positive-pressure flow velocity according to difference in elevation<br>positive-pressure flow velocity according to stack effect | positive-pressure flow velocity according to difference in temperature |

METHOD AND DEVICE FOR CONTROLLING VENTILATION AMOUNT WITH RESPECT TO SEALED PIPE

CROSS-REFERENCE TO RELATED APPLICATIONS

This application claims the priority of Korean Patent Application No. 10-2016-0180101 filed on Dec. 27, 2016, in the Korean Intellectual Property Office, the disclosure of which is incorporated herein by reference.

BACKGROUND

Field

The present disclosure relates to a method and an apparatus for controlling a ventilatory volume of a closed-type duct, and particularly, to a method and an apparatus for controlling a ventilatory volume which are configured to inhibit harmful gases such as offensive odors and toxic substances from being released from a closed-type duct.

Description of the Related Art

In general, a closed-type duct used to transport or store contaminated fluids such as sewage and wastewater is installed under the ground or in buildings. The closed-type duct has various types of openings that are in communication with the atmosphere or outside air outside the interior, and harmful gases including offensive odors and toxic substances produced from contaminated fluids in the closed-type duct are released to the atmosphere and the life space such as the interior through the openings, which causes problems of inconvenience or damage to health.

In the related art, as a method of inhibiting the harmful gas from being released to the outside from the closed-type duct, there are a method of treating the contaminated fluid, which causes the harmful gas, by inputting chemicals or biological microorganism culture solutions, and a method of simply closing, as necessary, the openings of the closed-type duct, which adjoin the outside air, for example, duct air communication ports, duct inspection opening/closing ports, rainwater collector inlet ports, and discharge ports of the closed-type duct such as a sewage duct by using various opening/closing means. However, in the case of the former method of chemically or biologically treating the contaminated fluid, there is a limitation in that high costs are required and it is difficult to basically inhibit the harmful gas such as an offensive odor. In addition, the latter method of mechanically closing the openings may be performed at a relatively low cost, but there is a problem in that the original function of the closed-type duct is impaired and a separate operation of opening and closing the opening/closing means needs to be cumbersomely performed to normally operate the closed-type duct.

Meanwhile, the present inventors have proposed, in Korean Patent No. 10-1152571, a method of inhibiting an offensive odor produced in a closed-type duct such as a sewage duct installed under the ground from being released to the outside by using a deodorization device to remove an offensive odor and using a gas discharging device attached to the deodorization device to form a negative pressure in the closed-type duct. The method according to Korean Patent No. 10-1152571 is known as being capable of inhibiting the release of the harmful gas such as an offensive odor at a low cost without obstructing a continuous operation of the closed-type duct in comparison with the above-mentioned methods, but Korean Patent No. 10-1152571 does not propose a solution for quantitatively controlling a ventilatory volume required to form the negative pressure.

Therefore, in a case in which the corresponding apparatus according to Korean Patent No. 10-1152571 is actually applied, the ventilatory volume and the gas discharge amount, which are required to form the negative pressure, are arbitrarily/intuitively controlled by a builder, a designer, or an operator merely depending on experiences without a clear criterion, and as a result, operation costs are increased due to an excessive ventilatory volume or the production of harmful gases including offensive odors and toxic substances is not sufficiently inhibited due to an insufficient ventilatory volume.

SUMMARY

The present disclosure provides a method and an apparatus for quantitatively controlling a minimum ventilatory volume required to inhibit a release of harmful gases including offensive odors and toxic substances from a closed-type duct, and provides, as relevant practical criteria, a criterion related to a closed-type duct model to be controlled, a criterion related to a factor that affects the release of the harmful gases, and a criterion related to a ventilatory volume calculation formula to be applied.

The present inventors have recognized that the ventilatory volume needs to be minimally controlled from a practical point of view when quantitatively controlling the ventilatory volume required to inhibit the release of the harmful gases from the closed-type duct. To this end, the present inventors have completed the present disclosure by recognizing that (i) the closed-type duct is divided into a single main duct and multiple branch ducts in a planned area and depends on a closed-type duct model in which a negative pressure may be formed by a separately provided means for forcedly discharging gas, (ii) in a state in which no forced gas discharge from the closed-type duct is made, the harmful gas is released to the outside by natural positive-pressure flow velocities according to a difference in temperature, a difference in concentration, a difference in elevation of the duct, and a stack effect, inverse velocity values of the natural positive-pressure flow velocities are compared, the highest value is determined as a standard flow velocity, (iii) the standard flow velocity is assigned in a lump to flow velocities in the single main duct and the multiple branch ducts provided in the closed-type duct, a sum of the flow rate in the main duct and the flow rate in the multiple branch ducts is basically determined as a ventilatory volume by the means for forcedly discharging gas, and particularly, only the flow rates in the branch duct at the junction points are corrected and determined in a lump based on a ratio of a pressure loss in the main duct to a pressure loss in the branch duct, such that the flow velocity introduced through an effective gas flow cross-sectional area at a point of the main duct most distant from an installation point of the ventilation device may be controlled to a minimum value higher than 0 m/sec, and therefore, the ventilatory volume by the means for forcedly discharging gas may be controlled to a minimum ventilatory volume sufficient to form a negative pressure in the closed-type duct. The subject matters of the present disclosure based on the recognition and the knowledge in respect to the solution are as follows.

(1) A method of controlling a ventilatory volume for inhibiting a release of a harmful gas by forming a negative pressure in a closed-type duct by forcedly discharging gas by using one or more ventilation devices, in which (a) the closed-type duct is divided into a single main duct and one or more branch ducts in a planned area, (b) an inverse velocity value of a positive-pressure flow velocity of the harmful gas generated to the outside of the closed-type duct in a state in which no forced gas discharge by the ventilation device is made is determined as a standard flow velocity $V_{spvm}$, (c) the standard flow velocity $V_{spvm}$ is assigned in a lump to flow velocities in the single main duct and the one or more branch ducts provided in the closed-type duct, and based on the following ventilatory volume calculation formula 1, a sum of a flow rate $Q_{MO}$ at a boundary end of the main duct and a value made by correcting flow rates $Q_{Si}$ in the one or more branch ducts at junction points is determined as a minimum ventilatory volume $Q_{spvm}$ by the ventilation device, (Ventilatory Volume Calculation Formula 1)

$$Q_{SPVM} = Q_{MO} + \sum_{i=1}^{n} \left\{ Q_{Si} \times \left( \frac{P_{Mi}}{P_{Si}} \right)^{0.5} \right\}$$

in which i is the junction point between the main duct and the branch duct, $Q_{SPVM}$ is a total ventilatory volume ($m^3$/min) of the ventilation device, $Q_{MO}$ is a flow rate ($m^3$/min) at the boundary end of the main duct, $Q_{Si}$ is a flow rate ($m^3$/min) in the branch duct at junction point i, $P_{Mi}$ is a pressure loss (mmAq) in the main duct at the junction point i, $P_{Si}$ is a pressure loss (mmAq) in the branch duct at the junction point i, and $V_{SPVM}$ is a standard flow velocity (flow velocity assigned in a lump to the main duct and the branch duct when calculating $Q_{MO}$ and $Q_{Si}$).

(2) The method according to (1), in which the main duct is arbitrarily determined in the planned area.

(3) The method according to (1), in which the branch duct integrally includes all openings that merge with the main duct.

(4) The method according to (1), in which the main duct is structured to extend in a transverse direction, a longitudinal direction, and a combination thereof based on the ground surface.

(5) The method according to (1), in which the branch duct further includes a secondary branch duct that merges with the branch duct.

(6) The method according to (5), wherein a ventilatory volume is separately calculated for the corresponding branch duct by assuming that the branch duct and the secondary branch duct are the main duct and the branch duct, respectively, in the ventilatory volume calculation formula 1, and then the value is assigned to a flow rate before correction at a point at which the corresponding branch duct merges with the main duct when calculating the minimum ventilatory volume $Q_{spvm}$ with respect to the closed-type duct.

(7) The method according to (1), in which a boundary of the planned area is a criterion for a distance when calculating the pressure losses $P_{Mi}$ and $P_{Si}$ in the main duct 110 and the branch duct 120 by means of the ventilatory volume calculation formula 1.

(8) The method according to (1), in which a boundary end of the main duct is partially shield.

(9) The method according to (8), in which a partial shield ratio in respect to the boundary end of the main duct is equal to or lower than 90% based on a cross-sectional area of the boundary end.

(10) The method according to (1), in which at least some of the one or more branch ducts are entirely or partially shielded.

(11) The method according to (1), in which the ventilation device further has at least any one or more of deodorization, purification, cooling, and air supply functions in addition to the function of forcedly discharging gas.

(12) The method according to (1), in which the minimum ventilatory volume $Q_{spvm}$ is determined based on the following ventilatory volume calculation formula 2 by adding a marginal ventilatory volume, and the marginal ventilatory volume includes at least any one of a marginal ventilatory volume α determined in accordance with a structure of the closed-type duct and a marginal ventilatory volume β optionally designated, (Ventilatory Volume Calculation Formula 2)

$$Q_{SPVM} = Q_{MO} + \sum_{i=1}^{n} \left\{ Q_{Si} \times \left( \frac{P_{Mi}}{P_{Si}} \right)^{0.5} \right\} + \alpha + \beta$$

in which α is the marginal ventilatory volume ($m^3$/min) according to the structure of the closed-type duct, and β is the marginal ventilatory volume ($m^3$/min) optionally designated.

(13) The method according to (12), in which, the closed-type duct further includes a storage tank, and the marginal ventilatory volume α includes a marginal ventilatory volume by the storage tank.

(14) The method according to (1), in which the standard flow velocity $V_{spvm}$ is determined as an inverse velocity value of a positive-pressure flow velocity according to a difference in temperature between the inside and the outside of the closed-type duct.

(15) The method according to (14), in which the difference in temperature is determined as a value made by subtracting a lowest outside temperature from an average temperature in the closed-type duct based on a temperature gradient between the inside and the outside of the closed-type duct which is measured for a predetermined period of time.

(16) The method according to any one of (1), (14), and (15), in which the standard flow velocity $V_{spvm}$ is determined as a maximum value after comparing an inverse velocity value of a positive-pressure flow velocity according to a difference in temperature between the inside and the outside of the closed-type duct with at least any one selected from inverse velocity values of positive-pressure flow velocities according to a difference in concentration in the duct in the planned area, a difference in elevation, and a stack effect.

(17) A ventilation device for inhibiting a release of a harmful gas by forming a negative pressure in a closed-type duct, in which (a) the closed-type duct is divided into a single main duct and one or more branch ducts in a planned area, (b) an inverse velocity value of a positive-pressure flow velocity of the harmful gas generated to the outside of the closed-type duct in a state in which no forced gas discharge by the ventilation device is made is determined as a standard flow velocity $V_{spvm}$, (c) the standard flow velocity $V_{spvm}$ is assigned in a lump to flow velocities in the single main duct and the one or more branch ducts provided in the closed-type duct, and based on the following ventilatory volume calculation formula 1, a sum of a flow rate $Q_{MO}$ at a boundary end of the main duct and a value made by correcting flow rates $Q_{Si}$ in the one or more branch ducts at junction points is determined as a minimum ventilatory volume $Q_{spvm}$.

(Ventilatory Volume Calculation Formula 1)

$$Q_{SPVM} = Q_{MO} + \sum_{i=1}^{n} \left\{ Q_{Si} \times \left( \frac{P_{Mi}}{P_{Si}} \right)^{0.5} \right\}$$

in which i is the junction point between the main duct and the branch duct, $Q_{SPVM}$ is a total ventilatory volume ($m^3$/min) of the ventilation device, $Q_{MO}$ is a flow rate ($m^3$/min) at the boundary end of the main duct, $Q_{Si}$ is a flow rate ($m^3$/min) in the branch duct at the junction point i, $P_{Mi}$ is a pressure loss (mmAq) in the main duct at the junction point i, $P_{Si}$ is a pressure loss (mmAq) in the branch duct at the junction point i, and $V_{SPVM}$ is a standard flow velocity (flow velocity assigned in a lump to the main duct and the branch duct when calculating $Q_{MO}$ and $Q_{Si}$).

(18) The ventilation device according to (17), in which the ventilation device further has at least any one or more of deodorization, purification, cooling, and air supply functions in addition to the function of forcedly discharging gas.

The present disclosure may provide a quantitative criterion related to the minimum ventilatory volume required to inhibit the release of the harmful gas such as an offensive odor or a toxic substance from the closed-type duct, thereby reducing costs and maximizing operational efficiency. In addition, the quantitative criterion related to the minimum ventilatory volume may be universally applied to the closed-type ducts having various usages and shapes and may be an operational criterion practical to various types of ventilation devices.

BRIEF DESCRIPTION OF THE DRAWINGS

The above and other aspects, features and other advantages of the present disclosure will be more clearly understood from the following detailed description taken in conjunction with the accompanying drawings, in which:

FIG. 1 is a cross-sectional side view of a closed-type duct model according to an exemplary embodiment of the present disclosure;

FIG. 4 is a table showing positive-pressure flow velocities calculated in accordance with a difference in temperature according to the exemplary embodiment of the present disclosure;

FIG. 5 is a table showing positive-pressure flow velocities measured in accordance with a difference in concentration according to the exemplary embodiment of the present disclosure;

FIG. 6 is a table showing positive-pressure flow velocities calculated in accordance with a difference in elevation according to the exemplary embodiment of the present disclosure;

FIG. 7 is a table showing positive-pressure flow velocities calculated in accordance with a stack effect according to the exemplary embodiment of the present disclosure; and FIG. 8 is a table showing positive-pressure flow velocities compared and evaluated according to the exemplary embodiment of the present disclosure.

DETAILED DESCRIPTION OF THE PREFERRED EMBODIMENT

Figure 2:
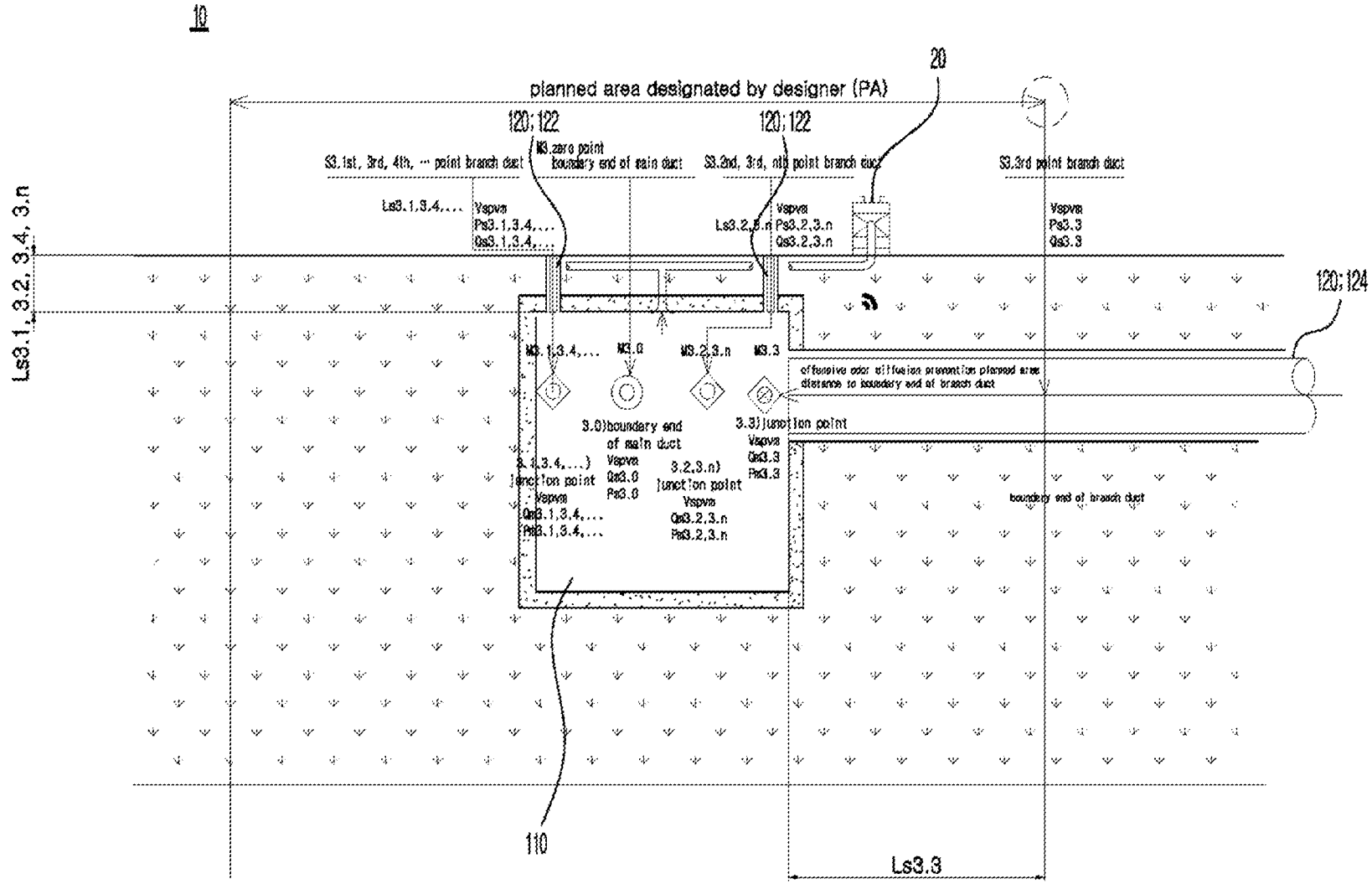
FIG. 2 is a cross-sectional front view of the closed-type duct model in FIG. 1.

Hereinafter, the present disclosure will be described in detail with reference to the exemplary embodiments. In addition, terms or words used in the specification and the claims should not be interpreted as being limited to a general or dictionary meaning and should be interpreted as a meaning and a concept which conform to the technical spirit of the present disclosure based on a principle that an inventor can appropriately define a concept of a term in order to describe his/her own invention by the best method. Therefore, the configurations of the exemplary embodiments disclosed in the present specification are just the best preferred exemplary embodiments of the present disclosure and do not represent all the technical spirit of the present disclosure. Accordingly, it should be appreciated that various equivalents and modified examples capable of substituting the exemplary embodiments may be made at the time of filing the present application. Meanwhile, the same or similar constituent elements and the equivalents thereof will be designated by the same or similar reference numerals. Further, throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

Hereinafter, (A) a criterion related to a closed-type duct model, (B) a criterion related to a factor that affects a release of a harmful gas, and (C) a criterion related to a calculation formula for a ventilatory volume to be applied, which constitute the present disclosure, will be sequentially described with reference to the exemplary embodiments.

(A) Criterion Related to Closed-Type Duct Model

Figure 3:
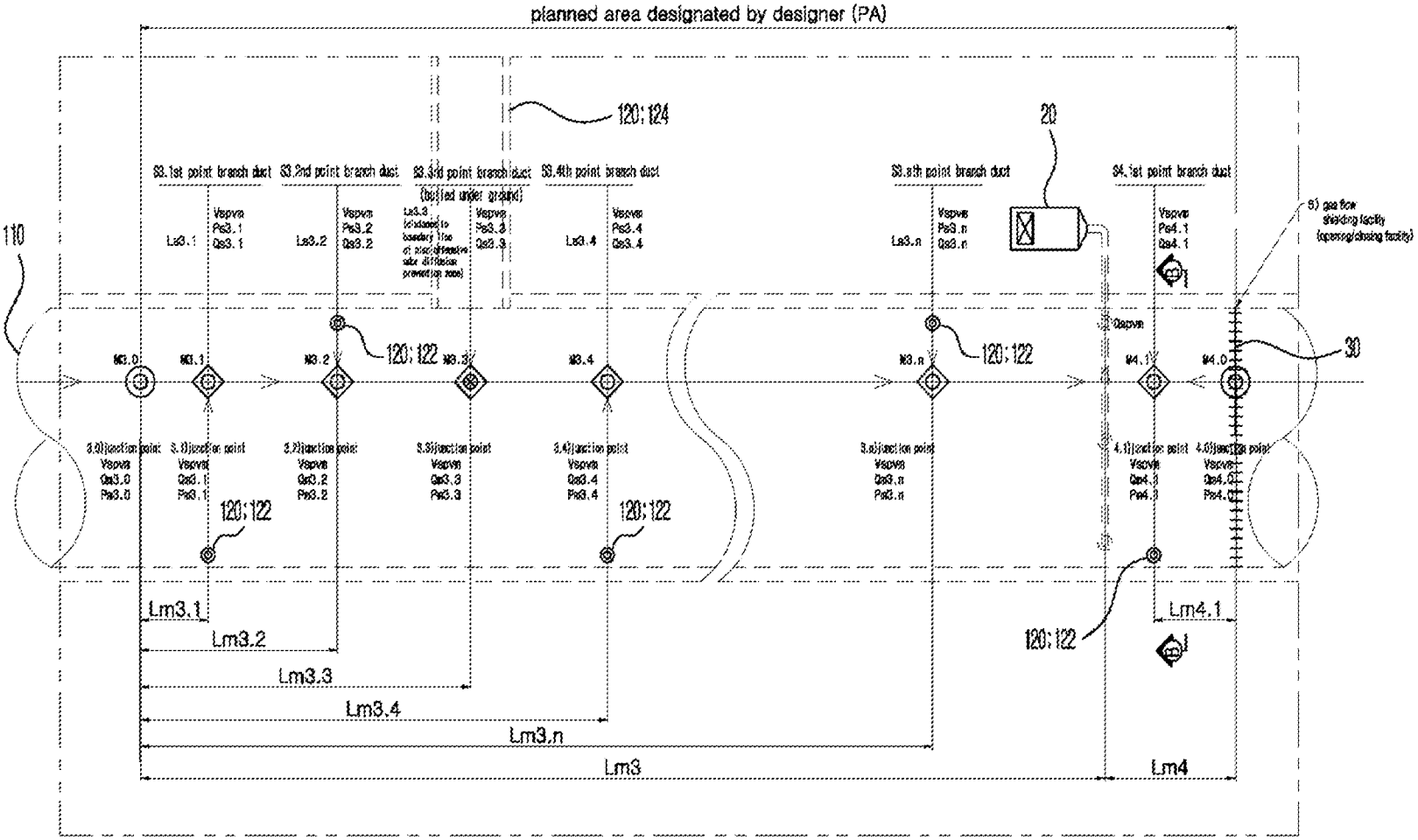
FIG. 3 is a top plan view of the closed-type duct model in FIG. 1.

FIGS. 1 to 3 are a cross-sectional side view, a cross-sectional front view, and a top plan view of the closed-type duct model according to the exemplary embodiment of the present disclosure. In the present disclosure, the closed-type duct model is associated with a subject and a range subjected to ventilatory volume control.

A closed-type duct 10 is divided into a single main duct 110 and multiple branch ducts 120 in a planned area PA in which a release of a harmful gas is inhibited. The closed-type duct 10 operates to inhibit the harmful gas from being released to the outside through the branch ducts 120 by forming a negative pressure in the closed-type duct 10 by forcedly discharging the gas by using a ventilation device 20 provided in a particular region of the main duct 110. In the exemplary embodiment, the closed-type duct 10 is illustrated as a sewage duct, such as a type of transverse duct, and the main duct 110 is structured to extend in an approximately transverse direction based on the ground surface.

The ventilation device 20 has a gas discharging function at a minimum to form the negative pressure in the closed-type duct 10 and may selectively further have, as necessary, a function of purifying inside air in the closed-type duct 10, which is introduced by the ventilation device 20, by deodorizing and decomposing the inside air, and a function of cooling the treated inside air or supplying the inside air into the closed-type duct 10. In particular, as a temperature in the closed-type duct 10 is decreased to be significantly lower than an outside temperature by the cooling and air supply functions, a positive-pressure flow velocity naturally generated in accordance with a difference in temperature, which will be described below, is advantageously decreased to inhibit the release of the harmful gas.

The main duct 110 is a single continuous duct that may be arbitrarily determined in the planned area PA in accordance with designer's intention regardless of physical shapes such as cross-sectional areas of the ducts that intersect one another. For example, in a case in which in comparison with a duct having a large cross-sectional area, a duct having a relatively small cross-sectional area is recognized as dominantly causing the release of the harmful gas in the planned area PA, the main duct 110 may be selected in accordance with the designer's intention despite the physical shape thereof.

The branch duct 120 integrally includes all openings that merge with the main duct 110, and the number of openings may be more than one. For example, a longitudinal branch duct 122 such as a rainwater collector inlet port and a duct inspection opening/closing port as illustrated in FIG. 1 merges with a longitudinal opening of the main duct 110. In addition, a transverse branch duct 124 illustrated in FIG. 2 is a branch duct in the narrow sense which has physically the same extension direction as the transverse main duct 110 according to the exemplary embodiment, and the transverse branch duct 124 merges with a transverse opening of the main duct 110. That is, in the present disclosure, the branch duct 120 integrally includes the openings, which are in communication with the main duct 110, regardless of the direction in which the branch duct 120 extends and merges. The reason is that an influence of the transverse branch duct 124 needs to be considered during a process of forming the negative pressure in the closed-type duct 10, such as a type of transverse duct, in the exemplary embodiment to prevent the harmful gas from being released to the longitudinal branch duct 122 that is directly in communication with the outside atmosphere or residential environment.

Meanwhile, the planned area PA is an area arbitrarily assigned by the designer, based on a duct arrangement view of the closed-type duct 10, to an area that inhibits the release of the harmful gas. As described above, the planned area PA is an element to be considered to select the main duct 110 of the closed-type duct 10, and particularly, a boundary of the planned area PA provides a criterion related to a distance variable in the following ventilatory volume calculation formula to calculate pressure losses $P_{Mi}$ and $P_{Si}$ in the main duct 110 and the branch duct 120. That is, by applying the ventilatory volume calculation formula, the pressure losses $P_{Mi}$ and $P_{Si}$ in the main duct 110 and the branch duct 120 are calculated based on a distance from the boundary of the planned area PA to a junction point, and the pressure losses $P_{Mi}$ and $P_{Si}$ are corrected by multiplying a flow rate value through an effective gas flow cross-sectional area of the branch duct 120 at the corresponding junction point by $(P_{Mi}/P_{Si})^{0.5}$ which is a square root of a pressure loss ratio. In this case, the effective gas flow cross-sectional area is a cross-sectional area through which a gas may pass, and for example, the effective gas flow cross-sectional area may be calculated by excluding a cross-sectional area occupied by liquids from the physical cross-sectional area of the duct when the liquids such as sewage and wastewater are introduced into the duct.

Optionally, the main duct 110 and/or the branch duct 120 may be configured to entirely or partially shield a gas flow in the duct in order to adjust the effective gas flow cross-sectional area. Specifically, at a boundary end of the main duct 110, that is, an end of the main duct 110 positioned at the boundary of the planned area PA, a shield ratio may be applied by using a shield ratio adjusting means 30, for example, in a range of 90% or less of a cross-sectional area at the boundary end. The effective gas flow cross-sectional area of the main duct boundary end 110 is decreased as the shield ratio is increased, and the ventilatory volume by the ventilation device 20 is also advantageously decreased. However, the excessive shield ratio is not advantageous because the original function of the closed-type duct 10 may be impaired. For the same purpose, at least some of the one or more branch ducts 120 may be shielded, and in this case, the shielded branch ducts 120 may be partially shielded by applying a predetermined shield ratio but may be entirely shielded as long as the original function of the closed-type duct 10 is not excessively impaired. The position at which the branch duct 120 is shielded may be the end of the branch duct 120 positioned at the boundary of the planned area PA, the junction point with the main duct 110, or a point at which the gas flow is easily shielded in the planned area.

Optionally, the closed-type duct 10 may further include an accessory structure (not illustrated in the drawings) positioned on a route of the main duct 110 or the branch duct 120 to perform a separate function. In a case in which the accessory structure affects the formation of the negative pressure in the closed-type duct 10, the accessory structure needs to be considered to calculate a minimum ventilatory volume for the closed-type duct according to the present disclosure. For example, in a case in which the accessory structure such as a storage tank having a large volume is provided on the route of the main duct 110, a gas discharge flow rate required to form the negative pressure in the closed-type duct 10 is increased, and as a result, it is necessary to add the gas discharge flow rate, as a kind of marginal ventilatory volume increased by the storage tank, when calculating the minimum ventilatory volume for the closed-type duct in accordance with the following ventilatory volume calculation formula. The marginal ventilatory volume produced by the storage tank which is a kind of accessory structure is an eigenvalue determined by a structure of the closed-type duct, and the eigenvalue may be calculated in accordance with a general formula known in the related art.

(B) Criterion Related to Factor Affecting Release of Harmful Gas

In the present disclosure, the selection and the evaluation of the factors, which affect the release of the harmful gas, are related to a standard flow velocity $V_{SPVM}$ which is a basis of the calculation of the minimum ventilatory volume. That is, in the present disclosure, the factor, which affects the release of the harmful gas, is related to driving power, that is, a positive-pressure flow velocity at which the harmful gas may be released to the outside in a state in which no gas is forcedly discharged from the closed-type duct 10. The positive-pressure flow velocity is naturally generated by an external environment factor or a structural factor of the closed-type duct 10, and particularly, an inverse velocity value thereof is assigned to the standard flow velocity $V_{SPVM}$ in the single main duct 110 and the multiple branch ducts 120 that constitute the closed-type duct 10 when forcedly discharging the gas by using the ventilation device 20, and the inverse velocity value is provided as a basis of the calculation of the minimum ventilatory volume by being applied to the following ventilatory volume calculation formula. Therefore, the positive-pressure flow velocity by the factor affecting the release of the harmful gas affects the standard flow velocity $V_{SPVM}$ applied to the following ventilatory volume calculation formula.

Hereinafter, based on the sewage duct model which is a kind of transverse duct of the closed-type duct models according to the present disclosure, a positive-pressure flow velocities according to a difference in temperature is illustratively selected as a basic factor, and positive-pressure flow velocities according to a difference in concentration, a difference in elevation, and a stack effect are illustratively selected as auxiliary factors, and a method of evaluating the positive-pressure flow velocities will be described.

(i) Evaluation of Basic Factor (Positive-Pressure Flow Velocities According to Difference in Temperature)

The positive-pressure flow velocities according to a difference in temperature is associated with the advection of the harmful gas generated by a difference in pressure between the inside and the outside of the duct. That is, when the heat exchange is performed between the inside and the outside of the duct for a predetermined period of time, a difference in temperature is generated between the inside and the outside of the duct by excessive energy accumulated in the duct, and a difference in pressure is generated between the inside and the outside of the duct in accordance with the difference in temperature, and as a result, the advection occurs through the longitudinal branch duct such as a rainwater collector.

A temperature gradient between the inside and the outside of the closed-type duct 10, which is measured for a predetermined period of time to help qualitative understanding, may be represented as a V-type temperature diagram, as illustrated in FIG. 1. In this case, because the positive-pressure flow velocity is generated from the inside to the outside of the duct when a temperature in the duct is higher than a temperature of the outside atmosphere, it is necessary to cancel out the positive-pressure flow velocity by forcedly discharging the gas from the closed-type duct 10 to prevent the harmful gas from being released to the outside of the duct.

The present disclosure is characterized by assigning, in a lump, the inverse velocity value of the maximum positive-pressure flow velocities according to the difference in temperature to the standard flow velocity $V_{SPVM}$ of the inflow flow rate through the single main duct 110 and the multiple branch ducts 120 that constitute the closed-type duct 10, and then applying the following ventilatory volume calculation formula while considering a phenomenon in which the maximum positive-pressure flow velocity is generated when the outside temperature is lowest when the inside of the duct is expected to be at an average temperature in a steady state, in order to quantify, to a minimum value, the amount of forcedly discharged gas required to inhibit the positive-pressure flow velocities according to the difference in temperature. In this case, as illustrated in FIG. 4, the standard flow velocity $V_{SPVM}$, that is, the inverse velocity value of the positive-pressure flow velocities according to the difference in temperature may be determined as an eigenvalue in proportion to a value made by subtracting a value of a lowest outside temperature $T_{out\text{-}min}$ from a value of an average temperature $T_{in\text{-}avg}$ in the closed-type duct 10.

Meanwhile, the following items may be considered when determining, as the standard flow velocity $V_{SPVM}$, the inverse velocity value of the positive-pressure flow velocities according to the difference in temperature. For example, the temperature measurement time is illustrated in FIG. 4 on a daily basis but may be determined on a weekly, monthly, quarterly, or annual basis, as necessary, in consideration of climate environments of installation locations or operational environments of the apparatus. In a case in which the temperature measurement time is set to be long in a location with severe seasonal changes, it may become easy to manage the operation of the apparatus, but the amount of forcedly discharged gas generated by the ventilation device needs to be increased more than necessary because a temperature deviation to be measured is increased, and thus operational efficiency may deteriorate. Therefore, it is necessary to select the temperature measurement time while considering these compatible elements. In addition, in a case in which the lowest outside temperature is higher at all times than a temperature of a fluid to be introduced into the closed-type duct, the importance of the basic factor related to the positive-pressure flow velocities according to the difference in temperature may be evaluated to be lower than the importance of the auxiliary factors related to the positive-pressure flow velocities according to the difference in concentration, the difference in elevation, and the stack effect.

(ii) Evaluation of Auxiliary Factors (Positive-Pressure Flow Velocities According to Difference in Concentration, Difference in Elevation of Duct, and Stack Effect)

In addition to the positive-pressure flow velocities according to the difference in temperature as the factor affecting the release of the harmful gas, at least any one of the positive-pressure flow velocities according to the difference in concentration, the difference in elevation, and the stack effect is evaluated as the auxiliary factor in order to determine the auxiliary factor value as the standard flow velocity $V_{SPVM}$ by comparing the positive-pressure flow velocities with the positive-pressure flow velocities according to the difference in temperature, to sufficiently reflect properties of sites, and to improve reliability of a minimum ventilatory volume $Q_{spvm}$ determined based on the following ventilatory volume calculation formula.

The positive-pressure flow velocity according to the difference in concentration is related to diffusion according to a difference in concentration of the harmful gas between the inside and the outside of the duct which is formed as the liquid in the duct is evaporated and becomes the harmful gas. In particular, in a case in which the lowest outside temperature is at all times higher than a temperature of the fluid to be introduced into the closed-type duct in accordance with the environment of the site, the positive-pressure flow velocity according to the difference in temperature is insignificant or is not generated. For this reason, the importance of the positive-pressure flow velocity according to the difference in concentration of the harmful gas may be evaluated to be relatively high. Meanwhile, the positive-pressure flow velocity according to the difference in concentration may be an eigenvalue that may be determined based on factors such as the type of harmful substance, a temperature of a liquid, a concentration of a harmful substance in a liquid, solubility of a harmful substance, a gas transfer velocity, a partial pressure of a harmful substance in the atmosphere, and a diffusion velocity in the atmosphere. Meanwhile, the positive-pressure flow velocity according to the difference in concentration may be determined by measuring traveling time by using a predetermined distance sensor, and FIG. 5 illustrates an example in which the positive-pressure flow velocity according to the difference in concentration is measured as an eigenvalue in the closed-type duct in the form of a sewage duct according to the exemplary embodiment of the present disclosure.

The positive-pressure flow velocity according to the difference in elevation is associated with the advection according to a change in flow rate or flow velocity in the duct. For example, the positive-pressure flow velocity is generated to the outside of the duct in the duct structure into which the liquid is rapidly introduced, and the positive-pressure flow velocity according to the difference in elevation may be calculated by obtaining a pressure by applying, for example, a publicly known ventilatory volume calculation formula in a tunnel which considering factors such as a velocity of a liquid, a period of a liquid, and a cross-sectional area of the duct, a cross-sectional area occupied by a liquid, and a temperature. FIG. 6 illustrates an example in which the positive-pressure flow velocity according to the difference in elevation is calculated as an eigenvalue in the closed-type duct in the form of a sewage duct according to the exemplary embodiment of the present disclosure.

The positive-pressure flow velocity according to the stack effect is associated with the advection according to a difference in pressure in a longitudinal duct such as a sewage duct at a high-altitude area. The positive-pressure flow velocity according to the stack effect may be restrictively considered in a special situation in which a high-temperature fluid is temporarily introduced into the sewage duct, which is a kind of transverse duct illustrated in FIGS. 1 to 3, and the difference in temperature is instantaneously increased. However, in the closed-type duct in the form of a longitudinal duct installed in a high-rise building or the like, the positive-pressure flow velocity according to the stack effect needs to be evaluated with relatively high importance. The positive-pressure flow velocity according to the stack effect may be calculated by using, for example, a publicly known formula related to the stack effect and considering factors such as a difference in temperature between the inside and the outside of the duct and a difference in altitude. FIG. 7 illustrates an example in which the positive-pressure flow velocity according to the difference in elevation is calculated as an eigenvalue in the closed-type duct in the form of a sewage duct according to the exemplary embodiment of the present disclosure.

(iii) Evaluation and Comparison Between Basic Factor and Auxiliary Factor

FIG. 8 is a table showing positive-pressure flow velocities compared and evaluated according to the exemplary embodiment of the present disclosure. As illustrated in FIG. 8, the inverse velocity value of the positive-pressure flow velocity according to the difference in temperature between the inside and the outside of the closed-type duct, which is evaluated as the basic factor, is compared with at least any one selected from the inverse velocity values of the positive-pressure flow velocities according to the difference in concentration, the difference in elevation, and the stack effect, which are evaluated as the auxiliary factors, the highest value is determined as the standard flow velocity $V_{spvm}$, and then the following ventilatory volume calculation formula is applied.

(C) Criterion Related to Ventilatory Volume Calculation Formula

Basically, the minimum ventilatory volume according to the present disclosure may be determined based on the following ventilatory volume calculation formula 1.

(Ventilatory Volume Calculation Formula 1)

$$Q_{SPVM} = Q_{MO} + \sum_{i=1}^{n} \left\{ Q_{Si} \times \left( \frac{P_{Mi}}{P_{Si}} \right)^{0.5} \right\}$$

$$Q_{MO} = A_{MO} \times V_{SPVM},\ Q_{Si} = A_{Si} \times V_{SPVM}$$

In the ventilatory volume calculation formula 1, i is a junction point between the main duct and the branch duct, $Q_{SPVM}$ is a total ventilatory volume ($m^3$/min) of the ventilation device, $Q_{MO}$ is a flow rate ($m^3$/min) at the boundary end of the main duct, $Q_{Si}$ is a flow rate ($m^3$/min) in the branch duct at the junction point i, $P_{Mi}$ is a pressure loss (mmAq) in the main duct at the junction point i, $P_{Si}$ is a pressure loss (mmAq) in the branch duct at the junction point i, $A_{MO}$ is an effective gas flow cross-sectional area ($m^2$) at the boundary end of the main duct, $A_{Si}$ is an effective gas flow cross-sectional area ($m^2$) at the boundary end of the branch duct, and the $V_{SPVM}$ is a standard flow velocity.

The flow rate $Q_{MO}$ at the boundary end of the main duct 110 and the flow rate $Q_{Si}$ in the branch duct 120 at the junction point are inflow flow rates generated when forcedly discharging the gas by using the ventilation device 10 and calculated by multiplying the effective gas flow cross-sectional areas $A_{MO}$ and $A_{Si}$ by the arbitrarily assigned standard flow velocity $V_{SPVM}$. In this case, the effective gas flow cross-sectional areas of the main duct 110 and the branch duct 120 may vary as described above depending on the application of the shield ratio of the duct and the cross-sectional areas occupied by the fluid in the ducts.

The pressure losses $P_{Mi}$ and $P_{Si}$ in the main duct and the branch duct at the junction points are eigenvalues that depend on distances from the boundary of the planned area PA to the junction points, and as described above, the boundary of the planned area PA provides a criterion in respect to the distances used to calculate the pressure losses $P_{Mi}$ and $P_{Si}$ in the main duct 110 and the branch duct 120.

Unlike a general ventilation theory in the related art, one of the features of the present disclosure related to the ventilatory volume calculation formula 1 is to correct 'only' the flow rate $Q_{Si}$ in the branch duct 120 at the junction point. This feature is basically related to the solution of forming the negative pressure to prevent the release of the harmful gas from the closed-type duct 10 and minimizing the negative pressure, and this feature will be specifically described.

In the general air conditioning field in the related art, it is necessary to increase the ventilatory volume (forced gas discharge and forced gas introduction) as possible to the extent that costs are acceptable in order to always maintain pleasant indoor air. A total flow rate $Q_{sum}$ at the junction point is calculated based on the sum of inflow flow rates $Q_{P\text{-}large}$ and $Q_{P\text{-}small}$ in the merging ducts and by adding a value corrected by multiplying the inflow flow rate $Q_{P\text{-}small}$ in the duct having a low pressure loss, as a result of comparing the pressure losses in the ducts, by $(P_{large}/P_{small})^{0.5}$ based on $Q_{sum}=Q_{P\text{-}large}+Q_{P\text{-}small}*(P_{large}/P_{small})^{0.5}$. In this case, $P_{large}>P_{small}$.

However, according to the general ventilation theory in the related art, only the allowable maximum ventilatory volume is just considered, but the configuration in which the minimum negative pressure is formed in the closed-type duct is not considered, such that there is no criterion related to determination and assignment of the standard flow velocity $V_{SPVM}$, which is another feature of the present disclosure. In particular, in a case in which the number of junction points is more than one, the ducts of which the inflow flow rates are to be corrected at the junction points need to be determined by being relatively compared each time for every junction point, and as a result, the calculation formula related to the total flow rate $Q_{sum}$ cannot be generalized, and consequently, it is very difficult in practice to derive the quantitative ventilatory volume for the particular purpose.

Therefore, in the present disclosure, the total ventilatory volume $Q_{SPVM}$ is determined by correcting only the flow rate in the branch duct 120 regardless of a difference in magnitude between the pressure loss $P_{Mi}$ in the main duct 110 and the pressure loss $P_{Si}$ in the branch duct 120 particularly at the junction points, such that it is possible to generalize the ventilatory volume calculation formula 1 regardless of the number of junction points i of the main duct 110 and the branch duct 120. The configuration of the present disclosure is applied together with the following configuration related to the determination and the assignment of the standard flow velocity $V_{SPVM}$, and as a result, it is possible to quantify the total ventilatory volume $Q_{SPVM}$ by the ventilation device 20 as the minimum value in order to form the minimum negative pressure in the closed-type duct 10.

Still another feature of the present disclosure related to the ventilatory volume calculation formula 1 is related to the determination and the assignment of the standard flow velocity $V_{SPVM}$. That is, as described above, the standard flow velocity $V_{SPVM}$ is determined as the maximum value among the inverse velocity values of the positive-pressure flow velocities at the basic factor and/or the auxiliary factor affecting the release of the harmful gas. The standard flow velocity $V_{SPVM}$, which is predetermined in this manner, is arbitrarily assigned in a lump to the flow velocities in the main duct 110 and the branch duct 120 illustrated in FIG. 1 when calculating the flow rate $Q_{MO}$ introduced through the boundary end of the main duct 110 in accordance with the forced gas discharge and the flow rate $Q_{Si}$ introduced through the branch duct 120 at the junction points.

In this case, when calculating the inflow flow rate in accordance with the forced gas discharge in the planned area, the standard flow velocity $V_{SPVM}$ is assigned in a lump to the flow velocities of the main duct 110 and the branch duct 120, and then the ventilatory volume calculation formula is applied, such that the flow velocity at the boundary end of the main duct 110 is constant as the standard flow velocity $V_{SPVM}$, but the flow velocities in the branch duct 120 at the junction points are corrected to the value made by multiplying the assigned standard flow velocity $V_{SPVM}$ by $(P_{Mi}/P_{Si})0.5$ which is a square root of the pressure loss ratio. That is, the standard flow velocity $V_{SPVM}$ is assigned in advance as the minimum value of the inflow flow velocity higher than 0 m/sec at the boundary end of the main duct 110 which is the point most distant from the installation point of the ventilation device 20, and the forced gas discharge is performed, such that the positive-pressure flow velocity of the harmful gas through the branch duct 120 may be cancelled out even though the flow velocity for the inflow flow rate through the branch duct 120 is corrected in a large or small range with respect to the standard flow velocity $V_{SPVM}$ assigned in advance.

Consequently, according to one of the features of the present disclosure, the configuration, which arbitrarily assigns in a lump the standard flow velocity $V_{SPVM}$ to the main duct 110 and the branch duct 120, may sufficiently control the amount of forcedly discharged gas by the ventilation device 20 and the total ventilatory volume $Q_{SPVM}$ to the minimum value that may inhibit the harmful gas from being released through the branch duct 120 of the closed-type duct 10.

Optionally, the ventilatory volume calculation formula 1 may substitute for the following ventilatory volume calculation formula 2, and the ventilatory volume calculation formula 2 is related to the determination of the minimum ventilatory volume $Q_{spvm}$ by adding a marginal ventilatory volume.

(Ventilatory Volume Calculation Formula 2)

$$Q_{SPVM} = Q_{MO} + \sum_{i=1}^{n} \left\{ Q_{Si} \times \left( \frac{P_{Mi}}{P_{Si}} \right)^{0.5} \right\} + \alpha + \beta$$

In the ventilatory volume calculation formula 2, α is a marginal ventilatory volume ($m^3$/min) according to the closed-type duct structure, and β is an optionally designated marginal ventilatory volume ($m^3$/min).

The marginal ventilatory volume may include at least any one of the marginal ventilatory volume α determined based on the structure of the closed-type duct 10 and the marginal ventilatory volume β designated optionally. The marginal ventilatory volume α is an element which is considered in a case in which a larger amount of discharged gas is required to form the negative pressure in the closed-type duct 10 because, for example, the accessory structure such as a storage tank having a large volume is provided on the route of the main duct 110 as described above. The marginal ventilatory volume α may be determined as an eigenvalue based on the structure of the closed-type duct 10 or the accessory thereof. The marginal ventilatory volume β is a value that may be optionally designated by a designer or a user for the purpose of safety operations of facilities including the closed-type duct 10.

The above description relates to the specific exemplary embodiments of the present disclosure. The exemplary embodiments according to the present disclosure are disclosed for the purpose of explanation but are not understood as limiting the scope of the present disclosure, and it should be understood that various alterations and modifications may be made by those skilled in the art without departing from the subject matter of the present disclosure.

Specifically, in the exemplary embodiments, the sewage duct, which is a kind of transverse duct for transporting sewage and wastewater, is simplified and illustratively described as the closed-type duct 10, but the present disclosure is not limited thereto. For example, the closed-type duct according to the present disclosure may be, in terms of the use thereof, a mean for intentionally collecting, transporting, or storing a harmful gas or a liquid causing the harmful gas in a planned region, and may be, in terms of the shape thereof, a transverse duct such as a sewage duct, a rainwater collecting duct, and a wastewater duct mainly installed under the ground, or a longitudinal duct installed inside and outside an apartment, a building, a factory, or the like. Furthermore, the range of the closed-type duct to which the present disclosure may be applied may include ducts having various usages and shapes in addition to the ducts clearly illustrated in the present specification as long as the ducts may be divided into the main duct and the branch duct in the planned area, as described above with reference to the exemplary embodiments.

In this case, in the exemplary embodiment, the marginal ventilatory volumes (α: the marginal ventilatory volume according to the structure of the closed-type duct and β: the optionally designated marginal ventilatory volume ($m^3$/min)), which are applied to the ventilatory volume calculation formula, and the factors, which affect the standard flow velocity, are described with respect to the sewage duct which is a kind of transverse duct, but the type, the importance, and the value thereof may vary depending on the type of closed-type duct.

In addition, in the exemplary embodiment and the relevant drawings, the extending direction and the merging direction of the main duct 110 and the branch duct 120 are illustrated as being a completely transverse or longitudinal direction for convenience of analysis and description, but the extending direction and the merging direction may not be an ideal transverse or longitudinal direction or may be a combination of the transverse and longitudinal directions. In this case, in a case in which the influence of the structural factor related to the extension direction of the main duct 110 and the branch duct 120 to the flow velocity and the flow rate is important, the structural factor may be separately considered based on the general formula in the related art.

In addition, in the exemplary embodiment and the relevant drawings, the configuration in which no accessory branch duct merges with the branch duct 120 is illustrated for convenience of analysis and description, a secondary branch duct (not illustrated in the drawings), which merges with the branch duct 120, may be further included. In a case in which the secondary branch duct has a high contribution to the generation of the offensive odor in the planned area PA and thus the secondary branch duct needs to be separately considered, the ventilatory volumes in the branch duct 120 are separately calculated by assuming that the branch duct 120 and the secondary branch duct are the main duct and the branch duct in the ventilatory volume calculation formula 1 or 2 according to the present disclosure, and then the value may be considered as the flow rate before correction at the point at which the branch duct 120 merges with the main duct 110 when calculating the minimum ventilatory volume for the closed-type duct 10. Therefore, in the ventilatory volume calculation formula 1 and 2 according to the present disclosure, the main duct and the branch duct are the elements that may be relatively recognized when dividing the planned area PA, and as the planned area PA is divided, an $n^{th}$ branch duct may be provided in an $(n-1)^{th}$ branch duct like the manner in which the secondary branch duct merges with the branch duct 120.

In addition, in the exemplary embodiment and the relevant drawings, the configuration in which the single ventilation device 20 is provided is illustrated for convenience of analysis and description, but multiple ventilation devices 20 may be provided in the case of special circumstances such as the planned area PA being made wide. In this case, in the ventilatory volume calculation formula 1 or 2 according to the present disclosure, the total ventilatory volume $Q_{SPVM}$ may be considered as a value made by summing up the ventilatory volumes of the ventilation devices.

In addition, in the exemplary embodiment, in the case in which the predetermined shield ratio is applied to adjust the effective gas flow cross-sectional area of the main duct 110 and/or the branch duct 120, the shield ratio may be resiliently adjusted in accordance with operational situations by using the shield ratio adjusting means 30 separately provided in the closed-type duct 20.

In addition, in the exemplary embodiment, the storage tank is illustratively described as an accessory structure that affects the marginal ventilatory volume $\alpha$ according to the structure of the closed-type duct.

Therefore, all of the modifications and the alterations may be understood as falling into the scope of the invention disclosed in the claims or the equivalents thereof.

What is claimed is:

1. A method of controlling a ventilatory volume for inhibiting a release of a harmful gas by forming a negative pressure in a closed-type duct by forcedly discharging gas by using one or more ventilation devices, wherein (a) the closed-type duct is divided into a single main duct and one or more branch ducts in a planned area, (b) an inverse velocity value of a positive-pressure flow velocity of the harmful gas generated to the outside of the closed-type duct in a state in which no forced gas discharge by the ventilation device is made is determined as a standard flow velocity $V_{spvm}$, (c) the standard flow velocity $V_{spvm}$ is assigned in a lump to flow velocities in the single main duct and the one or more branch ducts provided in the closed-type duct, and based on the following ventilatory volume calculation formula 1, a sum of a flow rate $Q_{MO}$ at a boundary end of the main duct and a value made by correcting flow rates $Q_{Si}$, in the one or more branch ducts at junction points is determined as a minimum ventilatory volume $Q_{spvm}$ by the ventilation device, and (Ventilatory Volume Calculation Formula 1)

$$Q_{SPVM} = Q_{MO} + \sum_{i=1}^{n} \left\{ Q_{Si} \times \left( \frac{P_{Mi}}{P_{Si}} \right)^{0.5} \right\}$$

wherein i is the junction point between the main duct and the branch duct, $Q_{spvm}$ is a total ventilatory volume ($m^3$/min) of the ventilation device, Qs, is a flow rate ($m^3$/min) in the branch duct at the junction point i, $P_{Mi}$ is a pressure loss (mmAq) in the main duct at the junction point i, $P_{Si}$ is a pressure loss (mmAq) in the branch duct at the junction point i, and $V_{spvm}$ is a standard flow velocity (flow velocity assigned in a lump to the main duct and the branch duct when calculating $Q_{MO}$ and $Q_{Si}$).

2. The method according to claim 1, wherein the main duct is arbitrarily determined in the planned area.

3. The method according to claim 1, wherein the branch duct integrally includes all openings that merge with the main duct.

4. The method according to claim 1, wherein the main duct is structured to extend in a transverse direction, a longitudinal direction, and a combination thereof based on the ground surface.

5. The method according to claim 1, wherein the branch duct further includes a secondary branch duct that merges with the branch duct.

6. The method according to claim 5, wherein a ventilatory volume is separately calculated for the corresponding branch duct by assuming that the branch duct and the secondary branch duct are the main duct and the branch duct, respectively, in the ventilatory volume calculation formula 1, and then the value is assigned to a flow rate before correction at a point at which the corresponding branch duct merges with the main duct when calculating the minimum ventilatory volume $Q_{spvm}$ with respect to the closed-type duct.

7. The method according to claim 1, wherein a boundary of the planned area is a criterion for a distance variable when calculating the pressure losses $P_{Mi}$ and $P_{Si}$ in the main duct 110 and the branch duct 120 by means of the ventilatory volume calculation formula 1.

8. The method according to claim 1, wherein a boundary end of the main duct is partially shielded.

9. The method according to claim 8, wherein a partial shield ratio in respect to the boundary end of the main duct is equal to or lower than 90% based on a cross-sectional area of the boundary end.

10. The method according to claim 1, wherein at least some of the one or more branch ducts are entirely or partially shielded.

11. The method according to claim 1, wherein the ventilation device further has at least any one or more of deodorization, purification, cooling, and air supply functions in addition to the function of forcedly discharging gas.

12. The method according to claim 1, wherein the minimum ventilatory volume $Q_{spvm}$ is determined based on the following ventilatory volume calculation formula 2 by adding a marginal ventilatory volume, and the marginal ventilatory volume includes at least any one of a marginal ventilatory volume α determined in accordance with a structure of the closed-type duct and a marginal ventilatory volume β optionally designated, and (Ventilatory Volume Calculation Formula 2)

$$Q_{SPVM} = Q_{MO} + \sum_{i=1}^{n}\left\{Q_{Si} \times \left(\frac{P_{Mi}}{P_{Si}}\right)^{0.5}\right\} + \alpha + \beta$$

wherein α is the marginal ventilatory volume ($m^3$/min) according to the structure of the closed-type duct, and β is the marginal ventilatory volume ($m^3$/min) optionally designated.

13. The method according to claim 12, wherein, the closed-type duct further includes a storage tank, and the marginal ventilatory volume α includes a marginal ventilatory volume by the storage tank.

14. The method according to claim 1, wherein the standard flow velocity $V_{spvm}$ is determined as an inverse velocity value of a positive-pressure flow velocity according to a difference in temperature between the inside and the outside of the closed-type duct.

15. The method according to claim 14, wherein the difference in temperature is determined as a value made by subtracting a lowest outside temperature from an average temperature in the closed-type duct based on a temperature gradient between the inside and the outside of the closed-type duct which is measured for a predetermined period of time.

16. The method according to claim 1, wherein the standard flow velocity $V_{spvm}$ is determined as a maximum value after comparing an inverse velocity value of a positive-pressure flow velocity according to a difference in temperature between the inside and the outside of the closed-type duct with at least any one selected from inverse velocity values of positive-pressure flow velocities according to a difference in concentration, a difference in elevation, and a stack effect.

17. A ventilation device for inhibiting a release of a harmful gas by forming a negative pressure in a closed-type duct, wherein (a) the closed-type duct is divided into a single main duct and one or more branch ducts in a planned area, (b) an inverse velocity value of a positive-pressure flow velocity of the harmful gas generated to the outside of the closed-type duct in a state in which no forced gas discharge by the ventilation device is made is determined as a standard flow velocity $V_{spvm}$, (c) the standard flow velocity $V_{spvm}$ is assigned in a lump to flow velocities in the single main duct and the one or more branch ducts provided in the closed-type duct, and based on the following ventilatory volume calculation formula 1, a sum of a flow rate $Q_{MO}$ at a boundary end of the main duct and a value made by correcting flow rates $Q_{Si}$, in the one or more branch ducts at junction points is determined as a minimum ventilatory volume $Q_{spvm}$, and (Ventilatory Volume Calculation Formula 1)

$$Q_{SPVM} = Q_{MO} + \sum_{i=1}^{n}\left\{Q_{Si} \times \left(\frac{P_{Mi}}{P_{Si}}\right)^{0.5}\right\}$$

wherein i is the junction point between the main duct and the branch duct, $Q_{spvm}$ is a total ventilatory volume ($m^3$/min) of the ventilation device, $Q_{Si}$ is a flow rate ($m^3$/min) in the branch duct at the junction point i, $P_{Mi}$ is a pressure loss (mmAq) in the main duct at the junction point i, $P_{Si}$ is a pressure loss (mmAq) in the branch duct at the junction point i, and $V_{spvm}$ is a standard flow velocity (flow velocity assigned in a lump to the main duct and the branch duct when calculating $Q_{MO}$ and $Q_{Si}$).

18. The ventilation device according to claim 17, wherein the ventilation device further has at least any one or more of deodorization, purification, cooling, and air supply functions in addition to the function of forcedly discharging gas.

19. The method according to claim 14, wherein the standard flow velocity $V_{spvm}$ is determined as a maximum value after comparing an inverse velocity value of a positive-pressure flow velocity according to a difference in temperature between the inside and the outside of the closed-type duct with at least any one selected from inverse velocity values of positive-pressure flow velocities according to a difference in concentration, a difference in elevation, and a stack effect.

20. The method according to claim 15, wherein the standard flow velocity $V_{spvm}$ is determined as a maximum value after comparing an inverse velocity value of a positive-pressure flow velocity according to a difference in temperature between the inside and the outside of the closed-type duct with at least any one selected from inverse velocity values of positive-pressure flow velocities according to a difference in concentration, a difference in elevation, and a stack effect.

* * * * *